US007081435B2

(12) United States Patent
Otsuhata et al.

(10) Patent No.: US 7,081,435 B2
(45) Date of Patent: Jul. 25, 2006

(54) THERMAL RECORDING MEDIUM

(75) Inventors: Takanori Otsuhata, Tokyo (JP); Tadakazu Fukuchi, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 10/500,360

(22) PCT Filed: Jan. 15, 2003

(86) PCT No.: PCT/JP03/00262

§ 371 (c)(1),
(2), (4) Date: Jun. 30, 2004

(87) PCT Pub. No.: WO03/059640

PCT Pub. Date: Jul. 24, 2003

(65) Prior Publication Data

US 2005/0043175 A1 Feb. 24, 2005

(30) Foreign Application Priority Data

Jan. 17, 2002 (JP) ..... 2002-008603

(51) Int. Cl.
*B41M 5/30* (2006.01)

(52) U.S. Cl. ..... 503/209; 427/150; 503/207; 503/208; 503/214

(58) Field of Classification Search ..... 427/150; 503/207, 208, 209, 214
See application file for complete search history.

(56) References Cited

U.S. PATENT DOCUMENTS

| | | | | |
|---|---|---|---|---|
| 4,977,133 | A | 12/1990 | Ishida et al. | |
| 6,037,308 | A | 3/2000 | Sato et al. | |
| 6,680,281 | B1 * | 1/2004 | Tajiri et al. | 503/209 |

FOREIGN PATENT DOCUMENTS

| | | |
|---|---|---|
| JP | 55159993 | 12/1980 |
| JP | 57189889 | 11/1992 |
| JP | 7149713 | 6/1995 |
| JP | 7266711 | 10/1995 |
| JP | 9207435 | 8/1997 |
| JP | 10000862 | 1/1998 |
| JP | 10297090 | 11/1998 |
| JP | 10297109 | 11/1998 |
| JP | 2000343831 | 12/2000 |
| WO | WO 9306074 | 4/1993 |
| WO | WO 9533714 | 12/1995 |

* cited by examiner

*Primary Examiner*—Bruce H. Hess
(74) *Attorney, Agent, or Firm*—Sherman & Associates

(57) ABSTRACT

The present invention is the thermally sensitive recording medium comprising a thermally sensitive color developing layer containing colorless or pale colored basic leuco dye and a color developing agent as a main components on a substrate, wherein said thermally sensitive recording layer contains acrylic emulsion and colloidal silica, further contains at least one kind of diphenylsulfone bridgeable compound represented by general formula A as the color developing agent, (A)

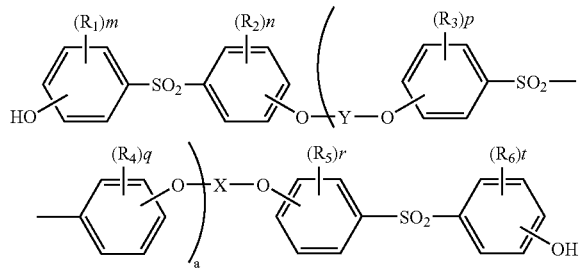

wherein, X and Y can be different or same and indicates a saturated or an unsaturated liner or grafted hydrocarbon group of carbon number 1–12 which can possess an ether bond, or indicate,

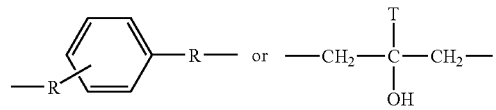

wherein, R indicates a methylene group or an ethylene group, T indicates a hydrogen atom or an alkyl group of carbon number 1–4, and $R_1$–$R_6$ independently indicate a halogen-atom, an alkyl group of carbon number 1–6, or an alkenyl group, further, m, n, p, q, r, t indicate an integer number of 0–4 and when are bigger than 2, $R_1$–$R_6$ can be different, and a is an integer of 0–10.

3 Claims, No Drawings

THERMAL RECORDING MEDIUM

FIELD OF THE INVENTION

The present invention relates to the thermally sensitive recording medium to which water resisting property is provided.

BACKGROUND OF THE INVENTION

In general, the thermally sensitive recording medium which develops a recorded image using coloring reaction of colorless or pale colored basic leuco dye with a color developing agent caused by heat is actually applied for the facsimile use, for the computer field or for various kind of measuring instrument, because of it's advantages e.g. excellent clear coloring, noiseless at the recording process, relatively cheap price and easy maintenance. Still more, recently, additionally to the uses for a label or a ticket, the uses for an output medium for various printers or plotters such as a handy terminal for outdoor measurement or a delivering split, are rapidly increasing. In the case of above mentioned uses, since these uses are usually outdoor use, the quality and function which can resist against more serious atmospheric condition than the ordinary condition are required. That is, for example, resistance to water or humidity caused by rain, resistance to sunshine or high temperature condition e.g. inside of car at the summer season are necessary.

Regarding the improvement of water resistance, the use of a water soluble adhesive together with various crosslinking agent is disclosed in Japanese Patent Laid Open Publication 55-159993 and the use of water soluble adhesive having high crosslinking ability is disclosed in Japanese Patent Laid Open Publication 57-189889, however, these techniques are not sufficient. In the meanwhile, the method to improve the water resistance by use of the hydrophobic resin emulsion such as vinyl acetate emulsion, acrylic emulsion or SBR latex as an adhesive for the thermally sensitive recording layer is well known, however, since this method has problems to cause cohesion of head deposit or sticking, the actual use of it is not so popular. Further, in Japanese Patent Laid Open Publication 7-266711, the use of complex particle emulsion composed of self crosslinking acrylic emulsion and colloidal silica and/or colloidal silica and acrylic polymer or styrene acrylic polymer are proposed, however, since the product has the problem that the ground color of white part is deteriorated when the product is kept in high humid condition, the thermally sensitive recording medium which is sufficient to the actual use is not accomplished yet.

OBJECT OF THE INVENTION

The object of the present invention is to provide a thermally sensitive recording medium which has excellent water resistance and is superior at printing aptitude and printing travelling ability, further, the coloring of ground color is small when maintained in high humid environment.

DISCLOSURE OF THE INVENTION

The present invention relates to a thermally sensitive recording medium comprising a thermally sensitive color developing layer containing colorless or pale colored basic leuco dye and a color developing agent as a main component on a substrate, wherein said thermally sensitive recording layer contains acrylic emulsion and colloidal silica, further contains at least one kind of diphenylsulfone bridgeable compound represented by general formula A as the color developing agent,

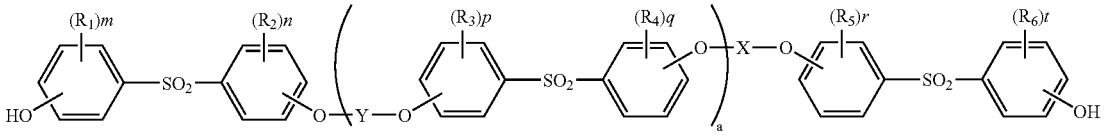

wherein, X and Y can be different or same and indicates a saturated or an unsaturated liner or grafted hydrocarbon group of carbon number 1–12 which can possess an ether bond, or indicate,

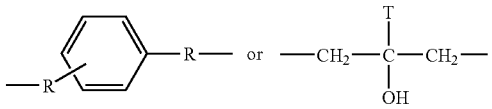

wherein, R indicates a methylene group or an ethylene group, T indicates a hydrogen atom or an alkyl group of carbon number 1–4, and $R_1$–$R_6$ independently indicate a halogen atom, an alkyl group of carbon number 1–6, or an alkenyl group, further, m, n, p, q, r, t indicate an integer number of 0–4 and when are bigger than 2, $R_1$–$R_6$ can be different, and a is an integer of 0–10.

In the present invention, the thermally sensitive recording medium having excellent water resistance can be obtained by containing acrylic emulsion and colloidal silica in a thermally sensitive recording layer. However, since the activity of colloidal silica is high, when acrylic emulsion and colloidal silica is contained in a thermally sensitive recording layer, the ground color of white part has a tendency to deteriorate if retained in the high humid environment. The inventors of the present invention have carried out an intensive study and have found that the above mentioned problem can be dissolved by an use of a specific compound represented by general formula (A) as a color developing agent, and accomplished the present invention.

DETAIL DESCRIPTION OF THE INVENTION

For the preparation of the thermally sensitive recording medium of the present invention, for example, following method can be mentioned. That is, dispersions in which a basic leuco dye or a color developing agent are severally dispersed with a binder, acrylic emulsion, colloidal silica, pigment and other necessary additives are mixed together, and the coating of thermally sensitive recording layer is prepared. Then, the thermally sensitive recording medium can be obtained by coating said prepared coating over the surface of substrate and by drying up.

In the present invention, it is important that the acrylic emulsion and the colloidal silica are contained in a thermally sensitive recording layer by mixing together with. A type of complex particle prepared by immobilizing colloidal silica into component of acrylic resin is known, but the water resistance of this complex particle is inferior to that of mixed type and therefore can not be used in the present invention. The reason why is not obvious, however, it is considered that said phenomenon is caused by the bonding condition of acrylic emulsion with colloidal silica. In the type of complex particle, colloidal silica is strongly bonded by polymerization bonding with an acrylic particle at the outer surface of it. And even if, it is used as an adhesive (binder) for the thermally sensitive recording layer, the fusing of acrylic particles themselves becomes difficult because of the presence of colloidal silica, and the film forming function is obstructed. On the contrary, in the case of mixing use, since colloidal silica is bonded weakly with acrylic particle and does not obstruct the bonding of acrylic particles themselves and the film forming function, accordingly the water resistance of it is improved.

As the acrylic emulsion used in the present invention, for example, aqueous emulsion of vinyl acetate-acrylic acid copolymer,
vinyl acetate-methacrylic acid copolymer,
vinyl acetate-alkylacrylate copolymer,
vinyl acetate-alkylmethacrylate copolymer,
acrylonitrile-acrylic acid copolymer,
acrylonitrile-alkylacrylate copolymer,
acrylonitrile-alkylmethacrylate copolymer,
acrylonitrile-methacrylicacid-alkylacrylate-alkylmethacrylate-styrene copolymer,
acrylonitrile-dialkylmethacrylateaminoalkyl-acrylamide copolymer,
acrylic acid-methacrylic acid copolymer,
metal salt of acrylic acid-alkylacrylate copolymer,
acrylic acid-alkylacrylate-acrylamide copolymer,
acrylic acid-methacrylamide-styrenic acid copolymer,
methacrylic acid-alkylacrylate-alkylmethacrylate copolymer,
metal salt of methacrylic acid-alkylacrylate-alkylmethacrylate copolymer,
methacrylic acid-alkylacrylate-alkylmethacrylate-acrylamide copolymer,
methacrylic acid-alkylmethacrylate copolymer,
alkylacrylate-acrylamide-styrene copolymer,
alkylmethacrylate-alkylacrylate-maleic anhydride copolymer,
alkylmethacrylate-alkylacrylate-metal salt of maleic anhydride copolymer,
alkylacrylate-styrene-metal salt of maleic anhydride copolymer,
alkylmethacrylate-fumaric acid copolymer,
alkylacrylate-metal salt of itaconic acid copolymer and denatured compound of them can be used, and at the preparation of aqueous emulsion, an emulsifier can be used when need is arisen.

In above mentioned acrylic emulsion, as the alkyl, a saturated hydro carbon of less than 10 carbon number such as methyl, ethyl, propyl, butyl, 2-ethylhexyl can be mentioned, and as the metal salt, salt of ammonium, Li, Na, K, Mg, Ca or Al can be mentioned.

The colloidal silica used in the present invention is used as the colloidal solution prepared by dispersing ultra fine particles of silicic anhydride in water. Desirably, the particle size of colloidal silica is 10–25 nm, more desirably is 10–20 nm. If the particle size of colloidal silica is too small, the stability of colloidal silica is deteriorated and if too large, the bonding strength of acrylic emulsion is weakened and be a ground to cause cohesion of head deposit or sticking. And the desirable pH of the colloidal solution is 7–10.

The desirable blending amount of the acrylic emulsion is 3–50 weight parts to 100 weight parts of thermally sensitive recording layer (hereinafter, weight part is converted by solid) and the more desirable blending amount is 5–30 weight parts When the blending amount of the acrylic emulsion is too small, the water resistance is not sufficient and when is too large, the sensitivity is deteriorated. The desirable blending amount of the colloidal silica is 1–100 weight parts to 100 weight parts of acrylic emulsion and more desirably is 10–60 weight parts. When the blending amount of the colloidal silica is too small, the cohesion of head deposit or sticking can be easily caused, and when is too large, the stability with the passing of time of the coating for thermally sensitive recording layer becomes a problem.

In the present invention, as the sensitizer, diphenylsulfone bridgeable type compound represented by general formula (A) is used. In the present invention the reason why the excellent effect is obtained is not clear, however, it is considered that the compound represented by general formula (A) does not cause the color developing reaction by high humid condition because the ratio of hydroxyl group (OH group) in the structure of said compound is small and less hydrophilicity.

The diphenylsulfone bridgeable type compound represented by general formula (A) is disclosed in Japanese Patent Laid Open Publication 10-29969, and can be purchased from the market, for example, by the commodity name of D-90 of Nihon Soda Co., Ltd. In the diphenylsulfone bridgeable type compound represented by general formula (A), the specific examples of groups represented by X and Y can be mentioned as follow. That is, methylene group, ethylene group, trimethylene group, tetramethylene group, pentamethylene group, hexamethylene group, heptamethylene group, octamethylene group, nonamethylene group, decamethylene group, undecamethylene group, dodecamethylene group, methylmethylene group, dimethylmethylene group, methylethylene group, methyleneethylene group, ethylethylene group, 1,2-dimethylethylene group, 1-methyltrimethylene group, 1-methyltetramethylene group, 1,3-dimethyltrimethylene group, 1-ethyl-4-methyl-tetramethylene group, vinylene group, propenylene group, 2-butenylene group, ethynylene group, 2-butynylene group, 1-vinylethylene group, ethyleneoxyethylene group, tetramethyleneoxytetramethylene group, ethyleneoxyethylene group, ethyleneoxymethyleneoxyethylene group, 1,3-dioxane-5,5-bismethylene group, 1,2-xylyl group, 1,3-xylyl group, 1,4-xylyl group, 2-hydroxytrimethylene group, 2-hydroxy-2-methyltrimethylene group, 2-hydroxy-2-ethyltrimethylene group, 2-hydroxy-2-propyltrimethylene group, 2-hydroxy-2-isopropyltrimethylene group and 2-hydroxy-2-butyltrimethylene group can be mentioned.

Alkyl or alkenyl group of $R_1$–$R_6$ is an alkyl group of $C_1$–$C_6$ or an alkenyl group of $C_1$–$C_6$, and as a specific example, methyl group, ethyl group, n-propyl group, isopropyl group, n-butyl group, sec-butyl group, tert-butyl group, n-pentyl group, isopentyl group, neopentyl group, tert-pentyl group, n-hexyl group, isohexyl group, 1-metylpentyl group, 2-methylpentyl group, vinyl group, allyl group, isopropenyl group, 1-propenyl group, 2-butenyl group, 3-butenyl group, 1,3-butandienyl group and 2-methyl-2-propenyl group can be mentioned.

And a halogen atom indicates chloride, bromine, fluorine or iodine.

In the present invention, as the diphenylsulfone bridgeable type compound represented by general formula (A), several kinds of compound whose substitution group and/or a number is different can be used by mixing together with, and the mixing ratio is voluntarily selected. And as the mixing method, mixing by powder, mixing in aqueous solution or the method to prepare plural kinds of diphenylsulfone bridgeable type compounds simultaneously can be mentioned and is not restricted. As the specific example of the compound represented by general formula (A), following compounds can be mentioned.

4,4'-bis[4-[4-(4-hydroxyphenylsulfonyl)phenoxy]-2-trans-butenyloxy]diphenylsulfone
4,4'-bis[4-(4-hydroxyphenylsulfonyl)phenoxy-4-butyloxy]diphenylsulfone
4,4'-bis[4-(4-hydroxyphenylsulfonyl)phenoxy-3-propyloxy]diphenylsulfone
4,4'-bis[4-(4-hydroxyphenylsulfonyl)phenoxy-2-ethyloxy]diphenylsulfone
4-[4-(4-hydroxyphenylsulfonyl)phenoxy-4-butyloxy]-4'-[4-(4-hydroxyphenylsulfonyl) phenoxy-3-propyloxy]diphenylsulfone
4-[4-(4-hydroxyphenylsulfonyl)phenoxy-4-butyloxy]-4'-[4-(4-hydroxyphenylsulfonyl) phenoxy-2-ethyloxy]diphenylsulfone
4-[4-(4-hydroxyphenylsulfonyl)phenoxy-3-propyloxy]-4'-[4-(4-hydroxyphenyl sulfonyl)phenoxy-2-ethyloxy]diphenylsulfone
4-4'-bis[4-(4-hydroxyphenylsulfonyl)phenoxy-5-pentyloxy]diphenylsulfone
4,4'-bis[4-(4-hydroxyphenylsulfonyl)phenoxy-6-hexyloxy]diphenylsulfone
4-[4-[4-hydroxyphenylsulfonyl]phenoxy]-2-trans-butenyloxy]-4'-[4-(4-hydroxyphenyl sulfonyl)phenoxy-4-butyloxy]diphenylsulfone
4-[4-(4-hydroxyphenylsulfonyl)phenoxy-2-trans-butenyloxy]-4'-[4-(4-hydroxyphenyl sulfonyl)phenoxy-3-propyloxy]diphenylsulfone
4-[4-[4-(4-hydroxyphenylsulfonyl)phenoxy]-2-trans-butenyloxy]--4'-[4- (4-hydroxy phenylsulfonyl)phenoxy-2-ethyloxy]diphenylsulfone
1,4-bis[4-[4-[4-(4-hydroxyphenylsulfonyl)phenoxy-2-trans-butenyloxy]phenyl sulfonyl]phenoxy]-cis-2-butene
1,4-bis[4-[4-[4-(4-hydroxyphenylsulfonyl)phenoxy-2-trans-butenyloxy]phenyl sulfonyl]phenoxy]-trans-2-butene
4,4'-bis[4-[4-(2-hydroxyphenylsulfonyl)phenoxy]butyloxy]diphenylsulfone
4,4'-bis[4-[2-(4-hydroxyphenylsulfonyl)phenoxy]butyloxy]diphenylsulfone
4,4'-bis[4-(4-hydroxyphenylsulfonyl)phenoxy-2-ethyl-enoxyethoxy]diphenylsulfone
4,4'-bis[4-(4-hydroxyphenylsulfonyl)phenyl-1,4-phenylenebismethyleneoxy]diphenylsulfone,
4,4'-bis[4-(4-hydroxyphenylsulfonyl)phenyl-1,3-phenylenebismethyleneoxy]diphenylsulfone
4,4'-bis[4-(4-hydroxyphenylsulfonyl)phenyl-1,2-phenylenebismethyleneoxy]diphenylsulfone
2,2'-bis[4-[4-[4-(4-hydroxyphenylsulfonyl)phenoxy-2-ethyleneoxyethoxy]phenyl sulfonyl]phenoxy]diethyl ether
α,α'-bis[4-[4-[4-(4-hydroxyphenylsulfonyl)phenyl-1,4-phenylenebismethyleneoxy]phenylsulfonyl]phenoxy]-p-xylene
α,α'-bis[4-[4-[4-(4-hydroxyphenylsulfonyl)phenyl-1,3-phenylenebismethyleneoxy]phenylsulfonyl]phenoxy]-m-xylene
α,α'-bis[4-[4-[4-(4-hydroxyphenylsulfonyl)phenyl-1,2-phenylenebismethyleneoxy]phenylsulfonyl]phenoxy]-o-xylene
2,4'-bis[2-(4-hydroxyphenylsulfonyl)phenoxy-2-ethyl-eneoxyethoxy]diphenylsulfone
2,4'-bis[4-(2-hydroxyphenylsulfonyl)phenoxy-2-ethyl-eneoxyethoxy]diphenylsulfone
4,4'-bis[3,5-dimethyl-4-(3,5-dimethyl-4-hydroxyphenylsulfonyl)phenoxy-2-ethylene oxyethoxy]diphenylsulfone
4,4'-bis[3-allyl-4-(3-allyl-4-hydroxyphenylsulfonyl)phenoxy-2-ethyleneoxyethoxy]diphenylsulfone
4,4'-bis[3,5-dimethyl-4-(3,5-dimethyl-4-hydroxyphenylsulfonyl)phenyl-1,4-phenylene bismethyleneoxy]diphenylsulfone
4,4'-bis[3,5-dimethyl-4-(3,5-dimethyl-4-hydroxyphenylsulfonyl)phenyl-1,3-phenylene bismethyleneoxy]diphenylsulfone
4,4'-bis[3,5-dimethyl-4-(3,5-dimethyl-4-hydroxyphenylsulfonyl)phenyl-1,2-phenylene bismethyleneoxy]diphenylsulfone
4,4'-bis[3-allyl-4-(3-allyl-hydroxyphenylsulfonyl)1,4-phenylenebismethyleneoxy]diphenylsulfone
4,4'-bis[3-allyl-4-(3-allyl-4-hydroxyphenylsulfonyl)1,3-phenylenebismethyleneoxy]diphenylsulfone
4,4'-bis[3-allyl-4-(3-allyl-4-hydroxyphenylsulfonyl)1,2-phenylenebismethyleneoxy]diphenylsulfone
4,4'-bis[4-(4-hydroxyphenylsulfonyl)phenoxy-2-hydroxypropyloxy]diphenylsulfone
1,3-bis[4-[4-[4-(4-hydroxyphenylsulfonyl)phenoxy-2-hydroxypropyloxy]phenyl sulfonyl]phenoxy]-2-hydroxypropane.

In the case, when several kind of diphenylsulfone bridgeable compounds are used by mixing together, the desirable compound is the compound wherein $R_1$–$R_6$ are same and only a value contains different two kinds. The producing method of said compound is easy, and by changing the reaction ratio of the starting materials the compounds having different a value can be synthesized by voluntarily containing ratio at one time. Among these compounds, the compound of a=0 is the compounds disclosed in Japanese Patent Laid-open Publication 7-149713, WO93/06074 and WO95/33714. And typically, following compounds can be mentioned.

1,3-bis[4-(4-hydroxyphenylsulfonyl)phenoxy]-2-hydroxypropane
1,1-bis[4-(4-hydroxyphenylsulfonyl)phenoxy]methane
1,2-bis[4-(4-hydroxyphenylsulfonyl)phenoxy]ethane
1,3-bis[4-(4-hydroxyphenylsulfonyl)phenoxy]propane
1,4-bis[4-(4-hydroxyphenylsulfonyl)phenoxy]butane
1,5-bis[4-(4-hydroxyphenylsulfonyl)phenoxy]pentane
1,6-bis[4-(4-hydroxyphenylsulfonyl)phenoxy]hexane
α,α'-bis[4-(4-hydroxyphenylsulfonyl)phenoxy]-p-xylene
α,α'-bis[4-(4-hydroxyphenylsulfonyl)phenoxy]-m-xylene
α,α'-bis[4-(4-hydroxyphenylsulfonyl)phenoxy]-o-xylene
2,2'-bis[4-(4-hydroxyphenylsulfonyl)phenoxy]diethyl ether
4,4'-bis[4-(4-hydroxyphenylsulfonyl)phenoxy]dibutyl ether
1,2-bis[4-(4-hydroxyphenylsulfonyl)phenoxy]ethylene
1,4-bis[4-(4-hydroxyphenylsulfonyl)phenoxy]-2-butene As the colorless or pale colored basic leuco dye, the conventional well known dyes in the field of a pressure sensitive type or thermally sensitive recording paper can be used. Desirably, triphenyl methane type compound, fluorane type compound, fluorene type compound and divinyl type compound can be used, however, not intended to be limited to them. Typical example of colorless or pale colored leuco dye (dye precursor) are mentioned below. Further, these dye precursors can be used alone or together with.

<Triphenylmethane Type Leuco Dyes>

3,3-bis(p-dimethylaminophenyl)-6-dimethylaminophthalide [another name is Crystal Violet Lactone]

3,3-bis(p-dimethylaminophenyl)phthalide [another name is Malachite Green Lactone]

<Fluorane Type Leuco Dyes>

3-diethylamino-6-methylfluorane
3-diethylamino-6-methyl-7-anilinofluorane
3-diethylamino-6-methyl-7-(o,p-dimethylanilino)fluorane
3-diethylamino-6-methyl-7-chlorofluorane
3-diethylamino-6-methyl-7-(m-trifluoromethylanilino)fluorane
3-diethylamino-6-methyl-7-(o-chloroanilino)fluorane
3-diethylamino-6-methyl-7-(p-chloroanilino)fluorane
3-diethylamino-6-methyl-7-(o-fluoroanilino)fluorane
3-diethylamino-6-methyl-7-(m-methylanilino)fluorane
3-diethylamino-6-methyl-7-n-octylanilinofluorane
3-diethylamino-6-methyl-7-n-octylaminofluorane
3-diethylamino-6-methyl-7-benzylaminofluorane
3-diethylamino-6-methyl-7-dibenzylaminofluorane
3-diethylamino-6-chloro-7-methylfluorane
3-diethylamino-6-chloro-7-anilinofluorane
3-diethylamino-6-chloro-7-p-methylanilinofluorane
3-diethylamino-6-ethoxyethyl-7-anilinofluorane
3-diethylamino-7-methylfluorane
3-diethylamino-7-chlorofluorane
3-diethylamino-7-(m-trifluoromethylanilino)fluorane
3-diethylamino-7-(o-chloroanilino)fluorane
3-diethylamino-7-(p-chloroanilino)fluorane
3-diethylamino-7-(o-fluoroanilino)fluorane
3-diethylamino-benzo[a]fluorane
3-diethylamino-benzo[c]fluorane
3-dibutylamino-6-methyl-fluorane
3-dibutylamino-6-methyl-7-anilinofluorane
3-dibutylamino-6-methyl-7-(o,p-dimethylanilino)fluorane
3-dibutylamino-6-methyl-7-(o-chloroanilino)fluorane
3-dibutylamino-6-methyl-7-(p-chloroanilino)fluorane
3-dibutylamino-6-methyl-7-(o-fluoroanilino)fluorane
3-dibutylamino-6-methyl-7-(m-trifluoromethylanilino)fluorane
3-dibutylamino-6-methyl-chlorofluorane
3-dibutylamino-6-ethoxyethyl-7-anilinofluorane
3-dibutylamino-6-chloro-7-anilinofluorane
3-dibutylamino-6-methyl-7-p-methylanilinofluorane
3-dibutylamino-7-(o-chloroanilino)fluorane
3-dibutylamino-7-(o-fluoroanilino)fluorane
3-di-n-pentylamino-6-methyl-7-anilinofluorane
3-di-n-pentylamino-6-methyl-7-(p-chloroanilino)fluorane
3-di-n-pentylamino-7-(m-trifluoromethylaniliono)fluorane
3-di-n-pentylamino-6-chloro-7-anilinofluorane
3-di-n-pentylamino-7-(p-chloroanilino)fluorane
3-pyrrolidino-6-methyl-7-anilinofluorane
3-piperidino-6-methyl-7-anilinofluorane
3-(N-methyl-N-propylamino)-6-methyl-7-anilinofluorane
3-(N-methyl-N-cyclohexylamino)-6-methyl-7-anilinofluorane
3-(N-ethyl-N-cyclohexylamino)-6-methyl-7-anilinofluorane
3-(N-ethyl-N-xylamino)-6-methyl-7-(p-chloroanilino)fluorane
3-(N-ethyl-p-toluidino)-6-methyl-7-anilinofluorane
3-(N-ethyl-N-isoamylamino)-6-methyl-7-anilinofluorane
3-(N-ethyl-N-isoamylamino)-6-chloro-7-anilinofluorane
3-(N-ethyl-N-tetrahydrofurfurylamino)-6-methyl-7-anilinofluorane
3-(N-ethyl-N-isobutylamino)-6-methyl-7-anilinofluorane
3-(N-ethyl-N-ethoxypropylamino)-6-methyl-7-anilinofluorane
3-cyclohexylamino-6-chlorofluorane
2-(4-oxahexyl)-3-dimethylamino-6-methyl-7-anilinofluorane
2-(4-oxahexyl)-3-diethylamino-6-methyl-7-anilinofluorane
2-(4-oxahexyl)-3-dipropyl amino-6-methyl-7-anilinofluorane
2-methyl-6-p-(p-dimethylaminophenyl)aminoanilinofluorane
2-methoxy-6-p-(p-dimethylaminophenyl)aminoanilinofluorane
2-chloro-3-methyl-6-p-(p-phenylaminophenyl)aminoanilinofluorane
2-chloro-6-p-(p-dimethylaminophenyl)aminoanilinofluorane
2-nitro-6-p-(p-diethylaminophenyl)aminoanilinofluorane
2-amino-6-p-(p-diethylaminophenyl)aminoanilinofluorane
2-diethylamino-6-p-(p-diethylaminophenyl)aminoanilinofluorane
2-phenyl-6-methyl-6-p-(p-phenylaminophenyl)aminoanilinofluorane
2-benzyl-6-p-(p-phenylaminophenyl)aminoanilinofluorane
2-hydroxy-6-p-(p-phenylaminophenyl)aminoanilinofluorane
3-methyl-6-p-(p-dimethylaminophenyl)aminoanilinofluorane
3-diethylamino-6-p-(p-diethylaminophenyl)aminoanilinofluorane
3-diethylamino-6-p-(p-dibutylaminophenyl)aminoanilinofluorane
2,4-dimethyl-6-[(4-dimethylamino)anilino]-fluorane <Fluorene Type Leuco Dyes>

3,6,6'-tris(dimethylamino)spiro[fluorene-9,3'-phthalide]
3,6,6'-tris(diethylamino)spiro[fluorene-9,3'-phthalide]

<Divinyl Type Leuco Dyes>

3,3-bis-[2-(p-dimethylaminophenyl)-2-(p-methoxyphenyl) ethenyl]-4,5,6,7-tetrabromo phthalide
3,3-bis-[2-(p-dimethylaminophenyl)-2-(p-methoxyphenyl) ethenyl]-4,5,6,7-tetrachloro phthalide
3,3-bis-[1,1-bis(4-pyrrolidinophenyl)ethylene-2-yl]-4,5,6,7-tetrabromophthalide
3,3-bis-[1-(4-methoxyphenyl)-1-(4-pyrrolidinophenyl)ethylene-2-yl]-4,5,6,7-tetra chlorophthalide <Others>

3-(4-diethylamino-2-ethoxyphenyl)-3-(1-ethyl-2-methylindol-3-yl)-4-azaphthalide
3-(4-diethylamino-2-ethoxyphenyl)-3-(1-octyl-2-methylindol-3-yl)-4-azaphthalide
3-(4-cyclohexylethylamino-2-methoxyphenyl)-3-(1-ethyl-2-methylindol-3-yl)-4-azapht halide
3,3-bis(1-ethyl-2-methylindol-3-yl)phthalide
3,6-bis(diethylamino)fluorane-γ-(3'-nitro)anilinolactam
3,6-bis(diethylamino)fluorane-γ-(4'-nitro)anilinolactam
1,1-bis-[2',2',2",2"-tetrakis-(p-dimethylaminophenyl)-ethenyl]-2,2-dinitrilethane
1,1-bis-[2',2',2",2"-tetrakis-(p-dimethylaminophenyl)-ethenyl]-2-β-naphthoyl ethane
1,1-bis-[2',2',2",2"-tetrakis-(p-dimethylaminophenyl)-ethenyl]-2,2-diacetylethane
bis-[2,2,2',2'-tetrakis-(p-dimethylaminophenyl)-ethenyl]-methylmalonic acid dimethyl ester.

In the present invention, as an adhesive contained in a thermally sensitive recording layer, namely, so called a binder, afore mentioned acrylic emulsion and colloidal silica are mainly used, and for the improvement of fluidity of the coating, a well known adhesive as the adhesive for the thermally sensitive recording layer can be used in the limitation not to hurt the desirable effect of the present invention. Specifically, full saponificated polyvinyl alcohol of 200–1900 polymerization degree, partial saponificated polyvinyl alcohol, denatured polyvinyl alcohol by carboxyl, denatured polyvinyl alcohol by amide, denatured polyvinyl alcohol by sulfonic acid, denatured polyvinyl alcohol by butylal, other denatured polyvinyl alcohol, derivatives of cellulose such as hydroxyethyl cellulose, methyl cellulose, carboxymethyl cellulose, ethyl cellulose and acetyl cellulose, copolymer of styrene-maleic unhydride, copolymer of styrene-butadiene, polyvinyl chloride, polyvinyl acetal, polyacrylicamide, polyacrylic acid ester, polyvinylbutylal, polystyrene or copolymer of them, polyamide resin, silicon resin, petroleum resin, terpene resin, ketone resin and cumarone resin can be illustrated. These macro molecule compounds can be applied by being dissolved into solvents such as water, alcohol, ketone, ester or hydrocarbon or by being dispersed in water or other medium under an emulsion state or a paste state and these forms of application can be used in combination according to the quality requirement.

In the present invention, a well known sensitizer can be used in the limitation not to hurt the desirable effect of the present invention. As the example of the sensitizer, ethylenebisamide,
montan acid wax,
polyethylene wax,
1,2-di-(3-methylphenoxy)ethane,
p-benzylbiphenyl,
β-benzyloxy naphthalene,
4-biphenyl-p-tolylether,
m-tarphenyl,
1,2-diphenoxyethane,
dibenzyl 4,4'-ethylenedioxy-bis-benzoate,
dibenzoyloxymethane,
1,2-di(3-methylphenoxy)ethylene,
1,2-diphenoxyethylene,
bis[2-(4-methoxy-phenoxy)]ethyl]ether,
p-nitromethyl benzoate,
dibenzyl oxalate,
di(p-chlorobenzyl)oxalate,
di(p-methylbenzyl)oxalate,
dibenzylterephthalate,
benzyl p-benzyloxybenzoate,
di-p-tolyl carbonate,
phenyl-α-naphthylcarbonate,
1,4-diethoxynaphthalene,
phenyl 1-hydroxy-2-naphthoate,
4-(m-methylphenoxymethyl)biphenyl,
o-toluenesulfoneamide and
p-toluenesulfoneamide can be mentioned, however, not intended to be limited to them.

These sensitizer can be used alone or used together with.

As a pigment which can be used in this invention, an inorganic pigment such as silica, calcium carbonate, kaoline, calcined kaoline, diatomaceous earth, talc, titanium oxide, or aluminum hydroxide or an organic pigment can be mentioned, however, not intended to be limited to them. In particular, the inorganic pigment of average particle size 3–30 μm is desirably used.

In the case when afore mentioned acrylic emulsion and colloidal silica are used together with, especially used under the low temperature atmosphere, sometimes a deletion in recorded image is caused, because cohesion of head deposit or sticking is caused by tackiness of acrylic emulsion. Since the thermally sensitive recording medium is used also in winter season or at the cold district, it is necessary to display good printing travelling ability at any environment. In the present invention said problem is dissolved by using an inorganic pigment having relatively large particle size, and desirable average particle size is 3–30 μm, more desirable particle size is 5–20 μm, most desirable particle size is 8–15 μm. In the present invention, the reason why such an excellent effect is obtained is not clear, however, it is considered that by containing the inorganic pigment having relatively large particle size, these larger particles are projected from the thermally sensitive layer and reduce the tight adherence between a printing head and the thermally sensitive recording layer and generates the sticking preventing effect. When the average particle size of the inorganic pigment is too small, it is difficult to be projected from the thermally sensitive layer projected and becomes hard to expect the above mentioned effect. On the contrary, when the average particle size of the inorganic pigment is too large, the quality of recorded image is deteriorated, and the defect at coating such as scratch or streak caused by deletion at the coating process is easily generated, and also is not desirable. In the present invention, the average particle size of the pigment is measured from the electric microscopic picture and calculated by volume base using Feret diameter.

Among the inorganic pigments, aluminum oxide is preferably used. The coating containing acrylic emulsion and colloidal silica, has a tendency to elevate the viscosity along with the time lapse, however, in the case when the aluminum oxide having a particle size prescribed In the present invention, the initiating time of viscosity elevating delays compared with the case containing other inorganic pigment, and is advantageous to carry out the stable operation. The reason why is not obvious, however, it is considered that when aluminum oxide is contained in the coating, said coating becomes basic and the stability of acrylic emulsion is improved.

As the blending amount of the inorganic pigment, it is desirable to be 5–200 weight parts to 100 parts of acrylic emulsion by converted to the solid part. Further, if the oil absorbing amount of inorganic pigment is smaller than 100 ml/100 g, printing aptitude is improved and is desirable. The reason why is considered as follows. That is, because by characterizing to said limitation of oil absorbing amount, the deterioration of the intensity of the coated layer by the absorption of the acrylic emulsion does not occur.

Furthermore, a slipping agent such as waxes, an UV ray absorbing agent such as benzophenone type and triazole type, a water resistance agent such as glyoxal, a dispersing agent, a defoamer, an antioxidant and a fluorescent dye can be used.

Still more, in the present invention, as the stabilizer which provides oil resistance of the recorded image, 4,4'-butylidene(6-t-butyl-3-methylphenol),
2,2'-di-t-butyl-5,5'-dimethyl-4,4'-sulfonyldiphenol,
1,1,3-tris(2-methyl-4-hydroxy-5-cyclohexylphenyl)butane,
1,1,3-tris(2-methyl-4-hydroxy-5-t-butylphenyl)butane and
4-benzyloxy-4'-(2,3-epoxy-2-methylpropoxy)diphenylsulfone epoxy resin can be added in the limitation not to hurt the desirable effect of the present invention.

The kind and amount of basic leuco dye, color developing agent and other components to be used in the thermally sensitive recording medium of the present invention are decided according to the required efficiency and printing aptitude and not restricted, however, in general, 0.5–10 weight parts of color developing agent and 0.5–10 weight around of filler to 1 weight part of basic leuco dye are used.

By coating the coating composed of above mentioned constitution on a voluntary substrate such as paper, regenerated paper, synthetic paper, film, plastic film, plastic film foam or non-woven cloths color developing agent, the objected thermally sensitive recording sheet can be obtained. Further, a complex sheet combining these sheets can be used as the substrate.

Basic leuco dye, color developing agent and materials to be added when needs are arisen are pulverized by a ball mill, an attriter or a sand grinder, or by means of an adequate emulsifying apparatus, until they are pulverized to the under micron size, then acrylic emulsion, colloidal silica and various additives are added according to the object and prepare the coating. The measure to coat the coating is not particularly restricted and can be coated according to the well known art, for example, the off machine coating apparatus or the on machine coating apparatus providing various coater such as an air knife coater, a rod blade coater, a bill blade coater or a roll coater can be voluntarily selected and used. The coating amount to the thermally sensitive recording layer is ordinary 2–12 g/m$^2$ by dry weight, desirably is 3–10 g/m$^2$.

In the present invention, it is desirable that the thermally sensitive recording layer is prepared by an air knife coating method using an air knife coater, among various coating methods. The air knife coating method is the method to adjust the coating amount by coating speed or air knife pressure. As the coating method to the thermally sensitive recording layer, the conventional methods such as bend blade method or bar blade method are popular. However, in the case of the coating for thermally sensitive recording layer using acrylic emulsion, since the viscosity of it is lower than that of the coating using polyvinyl alcohol binder or others, it is difficult to secure the necessary coating amount, therefore it is difficult to obtain sufficient coloring sensitivity. On the contrary, compared with the conventional bend blade coating method or bar blade coating method, the air knife coating method has an advantage that the limit to regulate the coating amount is wider and is possible to secure the desired coating amount. The suitable coating speed of air knife coater is from 30 to 1500 m/min and the suitable air knife pressure is from 200 to 8000 mm $H_2O$.

The thermally sensitive recording medium of the present invention can prepare an undercoat layer composed of polymer substance containing a filler under the thermally sensitive recording layer. Further, it is possible to prepare a back coat layer to the opposite surface of the substrate reversing to the thermally sensitive recording layer so as to correcting the curling. Furthermore, in the present invention, it is possible to carry out various well known techniques in the concerned field as the additional processing, for example, a smoothing process e.g. a super calendering after coating process of each layer.

EXAMPLE

The thermally sensitive recording medium of the present invention will be illustrated more specifically according to the Examples and the Comparative Examples, however, not intended to be limited by them. In the Examples and the Comparative Examples, "parts" indicates "weight parts".

[Synthesis Example of Diphenylsulfone Bridgeable Compound Represented by General Formula (A)]

16.0 g (0.4 mole) of sodium hydroxide is added to 21.2 g of water and dissolved, then 50.0 g (0.2 mole) of BPS is added. Then, 14.3 g (0.10 mole) of bis(2-chloroethyl)ether is added at the temperature of 105° C., reacted for 5 hours at the temperature of 110–115° C. After the reaction is over, 375 ml of water is added to the reacted solution, stirred at the temperature of 90° C. for 1 hour. Then cooled down to the room temperature, neutralized by 20% sulfuric acid. The crystallized solid is filtrated, and 39.3 g of white crystalline is obtained. The yield to bis(2-chloroethyl)ether is 88%. The obtained component is analyzed by high performance liquid chromatography and identified as follows. As the column, Mightysil RP-18 (product of Kanto Chemical Co., Ltd.) is used, and moving bed is $CH_3CN:H_2O:1\%H_3PO_4$=700:300:5, and UV wave length is 260 nm.

a=0: retention time 1.9 minutes: area % 32.9
a=1: retention time 2.3 minutes: area % 21.7
a=2: retention time 2.7 minutes: area % 12.8
a=3: retention time 3.4 minutes: area % 8.8
a=4: retention time 4.2 minutes: area % 5.8
a=5: retention time 5.4 minutes: area % 3.5
a=6: retention time 7.0 minutes: area % 2.2
a=7: retention time 9.0 minutes: area % 1.7
a=8: retention time 11.8 minutes: area % 1.3
a=9: retention time 15.4 minutes: area % 1.3

Example 1

Dispersions of Each materials of dye and color developing agent are prepared according to the following blending ratio, and are ground in the wet condition to average particle diameter of 0.5 μm using a sand grinder.

| | |
|---|---|
| <Dispersion of color developing agent> | |
| compound obtained in Synthesis Example | 6.0 parts |
| 10% aqueous solution of polyvinyl alcohol | 18.8 parts |
| water | 11.2 parts |
| <Dispersion of color developing agent> | |
| 3-di-n butylamino-6-methyl-7-anilinofluorane [ODB-2] | 3.0 parts |
| 10% aqueous solution of polyvinyl alcohol | 6.9 parts |
| water | 3.9 parts |
| <Dispersion of sensitizer> | |
| stearic acid amide(average particle size 0.4 μm) | 6.0 parts |
| 10% aqueous solution of polyvinyl alcohol | 18.8 parts |
| water | 11.2 parts |

The coating for thermally sensitive recording layer is obtained by mixing following compositions. The obtained coating is coated over the surface of woodfree paper of 50 g/m$^2$ using an air knife coater under the condition of 100 m/min coating speed and 1000 mm$H_2O$ air knife pressure, and dried up so as the coating amount after dried up to be 6 g/m$^2$, then is treated by a super calendar so as the Beck smoothness to become 500–600 sec. Thus the thermally sensitive recording medium is obtained.

| | |
|---|---|
| Dispersion of color developing agent | 36.0 parts |
| Dispersion of dye | 13.8 parts |
| Dispersion of sensitizer | 36.0 parts |
| 50% dispersion of aluminum oxide (ave. particle size; 8 μm, oil absorbing amount) | 26.0 parts |
| 30% dispersion of zinc stearate | 6.7 parts |
| Acrylic emulsion (Product of Clariant Polymer Co., Ltd., Movinyl 735) | 20.0 parts |
| Colloidal silica (ave. particle size; 12 nm) | 5.0 parts |

Example 2

By same process to Example 1 except using colloidal silica of average particle size 30 nm instead of colloidal silica of average particle size 12 nm, thermally sensitive recording medium is obtained.

Example 3

By same process to Example 1 except using colloidal silica of average particle size 50 nm instead of colloidal silica of average particle size 12 nm, thermally sensitive recording medium is obtained.

Comparative Example 1

By same process to Example 1 except using 4,4'-isopropylidenediphenol (BPA) instead of the compound obtained in Synthesis Example as a color developing agent at the preparation of thermally sensitive recording layer, thermally sensitive recording medium is obtained.

Comparative Example 2

By same process to Example 1 except using 4,4'-isopropylidenediphenyl sulfone (BPS) instead of the compound obtained in Synthesis Example as a color developing agent at the preparation of thermally sensitive recording layer, thermally sensitive recording medium is obtained.

Comparative Example 3

By same process to Example 1 except not containing colloidal silica at the preparation of thermally sensitive recording layer, thermally sensitive recording medium is obtained.

Comparative Example 4

By same process to Example 1 except using 20.0 parts of polyvinylalcohol (product of Kuraray Co., Ltd.; PVA117) instead of 20.0 parts of acrylic emulsion and 5.0 parts of colloidal silica at the preparation of thermally sensitive recording layer, thermally sensitive recording medium is obtained.

Comparative Example 5

By same process to Example 1 except using acrylic emulsion/colloidal silica complex resin (Product of Clariant Polymer Co., Ltd., Movinyl 8020) instead of 20.0 parts of acrylic emulsion and 5.0 parts of colloidal silica at the preparation of thermally sensitive recording layer, thermally sensitive recording medium is obtained.

The specimen of thermally sensitive recording medium obtained in above mentioned Examples and Comparative Examples are evaluated according following items and the results are summarized in Table 1. In the Table, (1): printed by 0.25 mJ/dot, (2): printed by 0.34 mJ/dot.

[Coloring Sensitivity]

The printing test is made on the prepared thermally sensitive recording media using TH-PMD, product of Okura Electric Co., Ltd., by 0.25 mJ/dot and 0.38 mJ/dot impressive energy. Recording density after printing and after quality test are measured by means of Macbeth Densitometer (RD-914, amber filter used).

[Humidity Resistance]

Specimen from not color developed part is retained in the environment of 40° C., 90% RH for 24 hrs, then the density of developed image is measured by Macbeth Densitometer (amber filter used). The coloring of specimen is evaluated by following standard.

Density of image, less than 0.20: practically usable as the thermally sensitive recording medium.

Density of image, over 0.21: not practically usable as the thermally sensitive recording medium.

[Water Resistance]

One drop of water is dropped on the surface of thermally sensitive recording medium and after 10 seconds rubbed one time by tissue paper. Degree of peeling of the recorded surface is evaluated by visual inspection according to the following standard.

○: peeling is not observed on the recorded surface

X: many peelings are observed on the recorded surface

[Printing Aptitude]

RI printing is made on the surface of thermally sensitive recording medium using UV ink. Presence of ink deletion is evaluated by visual inspection according to the following standard.

○: ink deletion is not observed

X: many ink deletions are observed

[Printing Traveling Ability]

Under the environment of 5° C., thermal recording is carried out on the prepared thermally sensitive recording media using TH-PMD, which is a product of Ohkura Denki Co., by 0.34 mJ/dot impressive energy. Presence of cohesion of head deposit and sticking is evaluated according to the following standard.

<Cohesion of Head Deposit>

○: cohesion of head deposit can not be observed

Δ: small cohesion of head deposit are observed

X: many cohesion of head deposit are observed

<Sticking>

○: sticking is not caused

Δ: sticking is slightly caused

X: sticking is caused

TABLE 1

| | coloring sensitivity | | humidity | water | Printing | Printing traveling ability | |
|---|---|---|---|---|---|---|---|
| | (1) | (2) | resistance | resistance | aptitude | cohesion of head deposit | sticking |
| Example 1 | 0.90 | 1.15 | 0.14 | ○ | ○ | ○ | ○ |
| Example 2 | 0.88 | 1.12 | 0.15 | ○ | ○ | ○ | ○ |

TABLE 1-continued

| | coloring sensitivity | | humidity | water | Printing | Printing traveling ability | |
|---|---|---|---|---|---|---|---|
| | (1) | (2) | resistance | resistance | aptitude | cohesion of head deposit | sticking |
| Example 3 | 0.86 | 1.10 | 0.14 | ○ | ○ | Δ | Δ |
| Com. Ex. 1 | 1.00 | 1.23 | 0.22 | ○ | ○ | ○ | ○ |
| Com. Ex. 2 | 0.97 | 1.22 | 0.40 | ○ | ○ | ○ | ○ |
| Com. Ex. 3 | 0.85 | 1.10 | 0.15 | ○ | ○ | X | X |
| Com. Ex. 4 | 0.90 | 1.13 | 0.15 | X | X | ○ | ○ |
| Com. Ex. 5 | 0.88 | 1.13 | 0.14 | X | ○ | Δ | Δ |

Com. Ex.: Comparative Example

INDUSTRIAL APPLICABILITY

As clearly understand from the results of Table 1, the thermally sensitive recording media of the present invention has the advantage that the intensity of the thermally sensitive recording layer is improved, and has good water resistance and printing aptitude. Further, the thermally sensitive recording media of the present invention has the advantage that the cohesion of head deposit and sticking are not generated, and the coloring of ground of white part under high humid environment is improved. That is, the thermally sensitive recording media of the present invention is actually valuable.

What is claimed is:

1. A thermally sensitive recording medium comprising a thermally sensitive color developing layer containing colorless or pale colored basic leuco dye and a color developing agent as a main components on a substrate, wherein said thermally sensitive recording layer contains acrylic emulsion and colloidal silica, further contains at least one kind of diphenylsulfone bridgeable compound represented by general formula A as the color developing agent, (A)

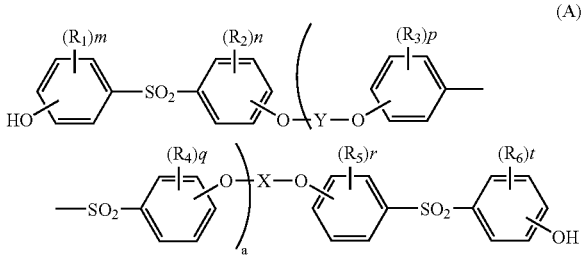

wherein X and Y can be different or same and indicates a saturated or an unsaturated liner or grafted hydrocarbon group of carbon number 1–12 which can possess an ether bond, or indicate,

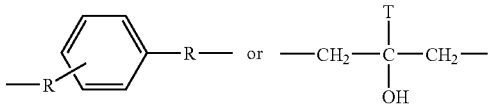

wherein, R indicates a methylene group or an ethylene group, T indicates a hydrogen atom or an alkyl group of carbon number 1–4, and $R_1$–$R_6$ independently a halogen atom, an alkyl group of carbon number 1–6, or an alkenyl group, further, m, n, p, q, r, t indicate an integer number of 0–4 and when are bigger than 2, $R_1$–$R_6$ can be different, and a is an integer of 0–10 said diphenylsulfone bridgeable compound having an average particle diameter of 0.5 μm, said colloidal silica having a particle size of 10–25 nm and, said acrylic emulsion being blended to the thermally sensitive recording layer in a blending amount of 3–50 weight parts of the acrylic emulsion to 100 weight parts of the thermally sensitive recording layer.

2. The thermally sensitive recording medium of claim 1, wherein the thermally sensitive recording layer contains inorganic pigment whose average particle size is 3 to 300 μm.

3. A method for the preparation of a thermally sensitive recording medium providing a thermally sensitive recording layer containing colorless or pale colored basic leuco dye and a color developing agent as a main components on a substrate, wherein said thermally sensitive recording layer contains acrylic emulsion and colloidal silica, comprising coating said thermally sensitive recording layer on said substrate by means of an air knife coater.

* * * * *